US012768268B1

(12) United States Patent
Pillai et al.

(10) Patent No.: US 12,768,268 B1
(45) Date of Patent: Oct. 20, 2026

(54) SURFACE TO DOWNHOLE COMMUNICATION SYSTEM

(71) Applicant: Halliburton Energy Services, Inc., Houston, TX (US)

(72) Inventors: Bipin Pillai, Sugar Land, TX (US); Michael Finke, Cypress, TX (US); Ranganathan Sridharan, Spring, TX (US); Thiago Santos Magalhaes, Spring, TX (US); Matthew Chong, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 19/235,110

(22) Filed: Jun. 11, 2025

(51) Int. Cl.
*E21B 47/20* (2012.01)
*E21B 34/06* (2006.01)

(52) U.S. Cl.
CPC ..... *E21B 47/20* (2020.05); *E21B 34/06* (2013.01)

(58) Field of Classification Search
CPC ..... E21B 47/12; E21B 47/14; E21B 47/18; E21B 47/20; E21B 47/22; E21B 47/24; E21B 34/06
See application file for complete search history.

(56) References Cited

U.S. PATENT DOCUMENTS 5,113,379 A * 5/1992 Scherbatskoy ..... E21B 47/12 367/83
5,963,138 A * 10/1999 Gruenhagen ..... E21B 47/18 367/43
6,920,085 B2 * 7/2005 Finke ..... E21B 47/22 340/854.3
8,042,572 B2 * 10/2011 Winnacker ..... F16K 47/04 175/48
8,547,246 B2 * 10/2013 Menezes ..... E21B 47/12 340/854.3
8,792,304 B2 * 7/2014 Sugiura ..... E21B 47/18 340/854.3
10,294,780 B2 * 5/2019 Barak ..... E21B 47/18
11,933,157 B2 3/2024 Dunbar et al.
2004/0100393 A1 5/2004 Sun et al.
2005/0056465 A1 3/2005 Virally et al.
2016/0123127 A1 5/2016 Walls
2023/0407742 A1 12/2023 Ou et al.
2025/0270926 A1 * 8/2025 Mahfoudh ..... E21B 47/18

OTHER PUBLICATIONS

International Search Report & Written Opinion; PCT Application No. PCT/US2025/035344; mailed Feb. 11, 2026.

* cited by examiner

*Primary Examiner* — Franklin D Balseca
(74) *Attorney, Agent, or Firm* — NOVAK DRUCE CARROLL LLP

(57) ABSTRACT

Aspects of the subject technology relate to systems, methods, and computer-readable media for communicating between control equipment on the earth's surface and a subsurface drilling assembly to command downhole instrumentation functions. Specifically, continuous wave modulation can be used whereby the signals are created on the surface, by venting or bypassing a small percentage of the drilling fluid away from the borehole, and received and decoded by a downhole receiver.

16 Claims, 7 Drawing Sheets

SURFACE TO DOWNHOLE COMMUNICATION SYSTEM

BACKGROUND

Technical Field

The present invention relates generally to communicating between control equipment on the earth's surface and a subsurface drilling assembly to command downhole instrumentation functions. In particular, the present invention relates to systems and methods for communicating instructions to the drilling assembly using a continuous wave modulation scheme by way of pressure pulse signals sent from a surface transmitter.

INTRODUCTION

A hydrocarbon drilling operation utilizes control and data collection equipment on the earth's surface and subsurface equipment such as a drilling assembly having drilling apparatus and formation evaluation tools that measure properties of the well being drilled. It has long been recognized in the oil and gas industry that communicating between the surface equipment and the subsurface drilling assembly is desirable.

BRIEF DESCRIPTION OF THE DRAWINGS

The various advantages and features of the present technology will become apparent by reference to specific implementations illustrated in the appended drawings. A person of ordinary skill in the art will understand that these drawings only show some examples of the present technology and would not limit the scope of the present technology to these examples. Furthermore, the skilled artisan will appreciate the principles of the present technology as described and explained with additional specificity and detail through the use of the accompanying drawings in which.

DETAILED DESCRIPTION

Figure 1:
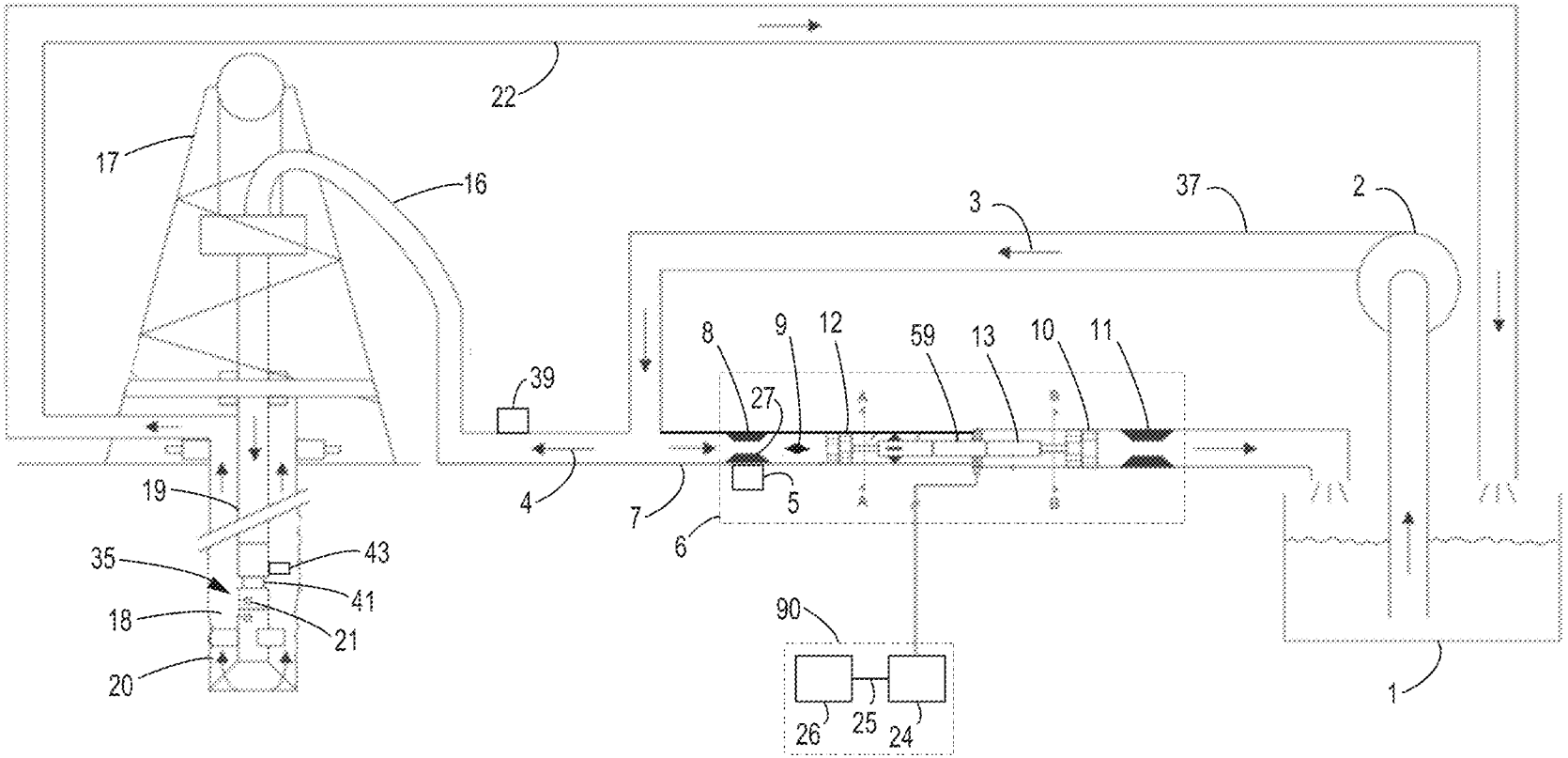
FIG. 1 illustrates an example drilling operation using mud pulse telemetry, according to some examples of the present disclosure.

The detailed description set forth below is intended as a description of various configurations of the subject technology and is not intended to represent the only configurations in which the subject technology can be practiced. The appended drawings are incorporated herein and constitute a part of the detailed description. The detailed description includes specific details for the purpose of providing a more thorough understanding of the subject technology. However, it will be clear and apparent that the subject technology is not limited to the specific details set forth herein and may be practiced without these details. In some instances, structures and components are shown in block diagram form to avoid obscuring the concepts of the subject technology.

Drilling (such as, but not limited to, for the purpose of extracting hydrocarbons from the earth, for example) can require a downhole drilling assembly, which may comprise, for example, directional drilling and formation evaluation tools. To operate these drilling tools, a communication link can be required between the control and data collection equipment on the surface and the downhole assembly as it drills a well below the surface of the earth.

Downlink signaling, or communicating from the surface equipment to the drilling assembly, is typically performed to provide instructions in the form of commands to the drilling assembly. For example, in a directional drilling operation, downlink signals may instruct the drilling apparatus to alter the direction of the drill bit by a particular angle or to change the direction of the toolface. Uplink signaling, or communicating between the drilling assembly and the surface equipment, is typically performed to verify the downlink instructions and to communicate data measured downhole during drilling to provide valuable information to the drilling operator.

A common method of downlink signaling is through mud pulse telemetry. When drilling a well, fluid is pumped downhole such that a downhole receiver within the drilling assembly can meter the pressure and/or flowrate of that fluid. Mud pulse telemetry is a method of sending signals by creating a series of momentary pressure changes, or pulses, in the drilling fluid, which can be detected by a receiver. For downlink signaling, the pattern of pressure pulses, including the pulse duration, amplitude, and time between pulses, is detected by the downhole receiver and then interpreted as a particular instruction to the downhole assembly.

Once the pressure pulses representing a certain instruction are generated on the surface and transmitted downhole, a receiver disposed in the downhole assembly must decode those signals to distribute the instruction to the proper downhole tool. The receiver will detect noise associated with the pump and drilling operations in addition to the downlink signal. Therefore, decoding the downlink signal in the downhole receiver typically comprises digital filtering steps to remove the noise and using a detection algorithm to match the pressure pulse sequence to a particular preprogrammed instruction in the downhole assembly controller.

These uplink and downlink telemetry systems can use filters and algorithms for analyzing the signals, but the uplink system can be significantly more sophisticated. Uplink transmission can involve large amounts of data that must be analyzed quickly, whereas downlink transmission can involve small amounts of data that can be analyzed over a longer time frame. For example, in some cases, the data rate for uplink signals can be about 240 bits per minute (however the uplink data rate can vary depending on environmental conditions, for example) whereas, in some examples, the data rate for downlink signals can vary between 8 bits per minute to about 22 bits per minute (with an average of about 12 bits per minute in some cases).

Further, the noise downhole is said to be lower than the noise near the surface, so the filtering feature is not as complicated downhole.

However, given the complicated functionality of modern day drilling assemblies, and especially in directional drilling applications, it can be desirable to have fast data rates for both uplink and downlink communications. Further, it can be desirable to provide a sophisticated downlink algorithm capable of fast and accurate signal decoding, including an internal error-checking capability. In fact, it can be desirable to achieve simultaneous, bi-directional communication (uplink and downlink) to send a downlink instruction that is decoded quickly, confirmed via uplink, and executed in fast progression, such that while one downlink instruction is being executed another downlink signal can be sent-either to the same tool or to a different tool. In directional drilling applications, the benefit of a fast bi-directional telemetry rate is the drilling of a very accurately located borehole that may be optimized for minimum drag since the drill bit angle and toolface can be corrected rapidly whenever it goes off course. The downlink telemetry system employing continuous wave modulation of pressure pulses of the present invention overcomes the deficiencies of the prior art.

A common way to achieve this communication link is through a method called mud pulse telemetry. Mud pulse telemetry can be used for sending signals from the surface to the downhole tools (downlink) or for sending signals from the downhole assembly to the surface (uplink). Generally, downlink communication can send instructions in the form of commands to the downhole tools, and uplink communication can confirm that the instructions are received by the downhole assembly and/or provide data to the surface.

Existing solutions can be extremely slow in transmitting data or commands from the surface to downhole tools (i.e., downlinking). In some examples, data transmitted during a downlink operation can be as slow as 0.2 bits per second (or less). However, as drilling operators are moving towards closed-loop automation, it can be important that commands and data be transmitted quickly to the downhole tools so that the tools can make adjustments in a timely manner. Further, current solutions rely on the wide-band Differential Pulse Position Modulation ("DPPM") which can also impact and/or interfere uplink telemetry.

The disclosed technology addresses the foregoing by employing continuous wave modulation (such as, but not limited to, quadrature phase-shift-keying ("QPSK")) whereby the signals are created on the surface by venting or bypassing a small percentage of the fluid away from the borehole. This type of modulation can be more narrow-band while still allowing a higher downlinking data rate. Additionally, it can also provide flexibility on which frequency band to transmit the downlink signals without impacting uplink telemetry. Further, it can also take advantage of venting the fluid at the surface to create pulses of sufficient amplitude and frequency that can be created without the limitations of a non-venting flowline pulser. Continuous wave modulation can provide the capability to transmit data at a frequency band that is either below or above the uplink telemetry frequency band.

The proposed solution further provides the capability to support more than one downlink telemetry modulation scheme (such as, but not limited to, QPSK and/or DPPM) at the same time. Further, the systems and methods can switch between different modulation schemes. Additional advantages can include the ability to self-adjust the pulse amplitude and/or downlink parameters using automation. An adjustable bean choke can further act as a low frequency pulser and when stationary, act as amplitude amplifier. When acting as low frequency pulser, it can work simultaneously with the high frequency siren pulser, effectively providing a frequency modulator combined with an amplitude modulator.

Referring to FIG. 1, there is depicted an example drilling operation where mud pulse telemetry may be used. A well bore 20, which can be open or cased, is disposed below a drilling rig 17. A drill string 19 with a drilling assembly 35 connected to the bottom, can be disposed within the well 20, forming an annular flow area 18 between the drill string 19 and the well 20. On the surface, a mud pump 2 can draw drilling fluid from the fluid reservoir 1 and pump the fluid into the pump discharge line 37, along path 3, 4. The circulating fluid can flow, as shown by the arrows, into the drilling rig standpipe 16, through the drill string 19, and return to the surface through the annulus 18. After reaching the surface, the circulating fluid can be returned to the fluid reservoir 1 via the pump return line 22.

In some examples, a series of pressure changes, called pulses, can be sent in a deterministic pattern to either an uplink receiver 39 on the surface or a downlink receiver 21 in the downhole assembly 35 to generate either uplink or downlink signals via mud pulse telemetry. The amplitude and frequency of the pressure changes are analyzed by the receivers 39, 21 to decode the information or commands being sent. For example, one uplink signal can be sent by momentarily restricting fluid downhole, at a valve 41 for example, as the fluid is pumped down the drill string 19. The momentary restriction can cause a pressure increase, or a positive pulse, when the fluid impacts the point of restriction. The positive pulse can flow back up the fluid in the drill string 19, and an uplink receiver 39 at the surface, typically a pressure transducer, can read the increase in pressure. An uplink signal can also be sent as a negative pulse by opening a valve 43 between the drill string 19 and the annulus 18 to allow fluid to escape, thereby creating a negative pressure wave that can travel to the surface receiver 39. Using this method, the downhole assembly 35 can communicate with the surface receiver 39 using either a positive pulser 41 or a negative pulser 43 that can create a series of pressure pulses that travel to the surface receiver 39.

One method for downlink communication can require the operator to interrupt drilling and cycle the drilling pump 2 on and off to create pressure pulses that traveled through the drill string 19 to the downhole receiver 21. Another method for downlink communication without interrupting drilling relies on wide-band Differential Pulse Position Modulation ("DPPM") which can impact and/or interfere uplink telemetry. However, the present invention comprises a system and method for downlinking without interrupting drilling using pressure pulses created and encoded using continuous wave modulation. Specifically, pressure pulses can be created and encoded using a continuous wave modulation scheme for downlink communications by momentarily bypassing a small percentage of the total flow. Continuous wave modulation can result in narrow-band and still allow for a faster downlinking data rate. The ability to communicate faster with the downhole tools can allow for smarter downhole tools that can take advantage of machine learning and also be designed for full automation. Specifically, by using this bypassing (i.e., "venting") method, larger pulses can be created that can allow for downhole tools to receive downlinks at deep wells. During the momentary bypass period, pressure and volumetric flow rate are reduced in the flow traveling downhole to create a negative pulse that is transmitted down the drill string 19. This negative pulse is detected downhole by the downhole receiver 21 as a momentary change in the fluid pressure and/or a change in the fluid velocity.

In some examples, the apparatus can comprise a surface transmitter assembly 6, a surface transmitter control system 90, and a downhole receiver 21. The control system 90 can comprise a computer 26, and a downlink controller/barrier box 24 housing certain control equipment that can be linked to a pneumatic system 59. The surface transmitter assembly 6, which is shown in the dotted box, may be designed to operate in any pressure range depending upon the application, such as, for example, an operating pressure of approximately 10,000 psi with a maximum pressure rating of 15,000 psi.

Figure 2A:
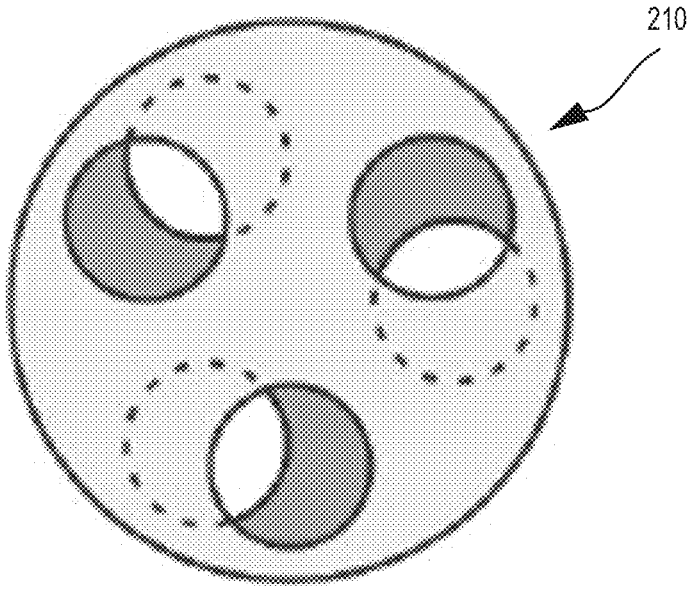
FIG. 2A illustrates an example flow restrictor, according to some examples of the present disclosure.
Figure 3:
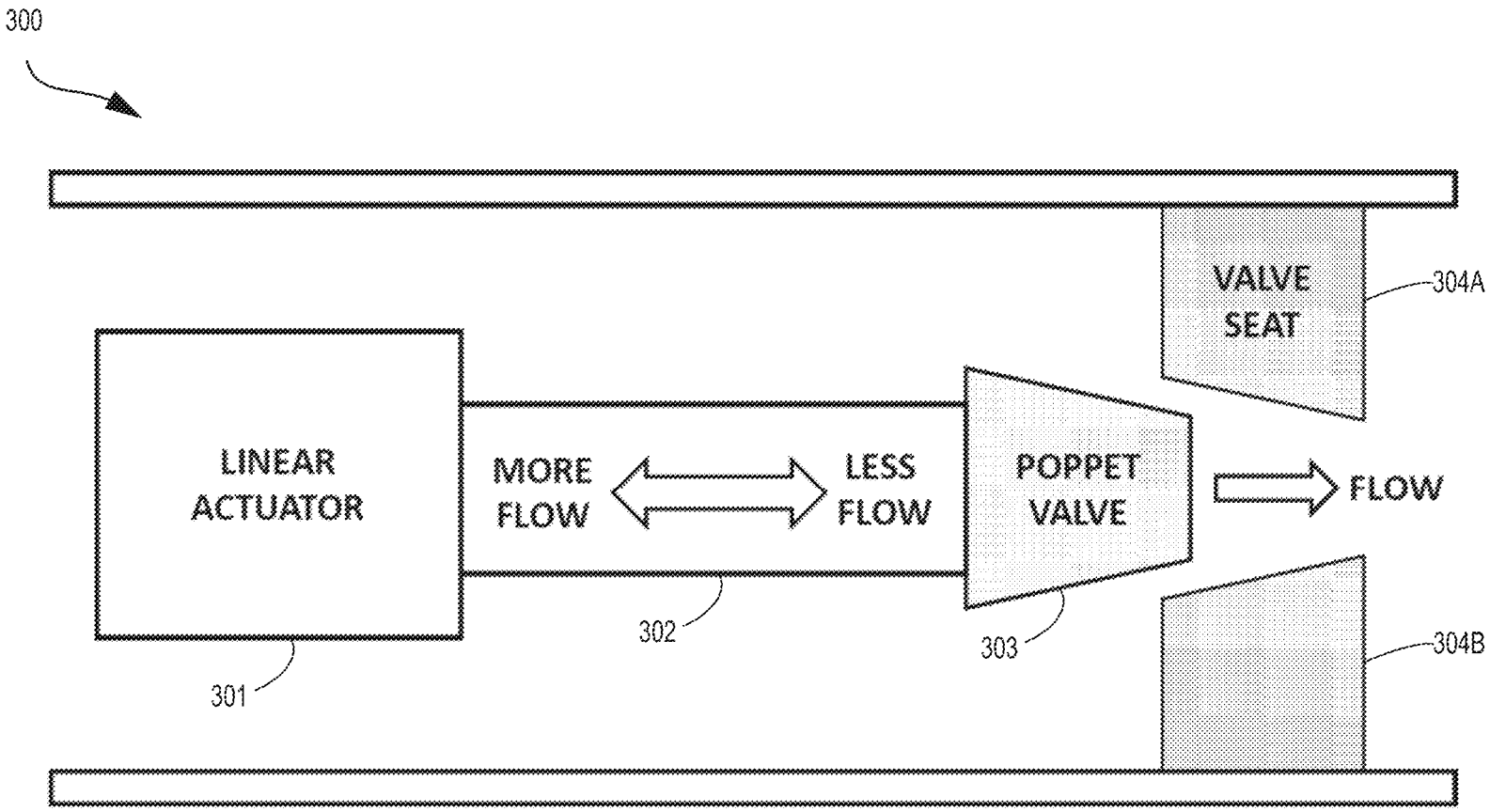
FIG. 3 illustrates an adjustable flow restrictor, according to some examples of the present disclosure.

The surface transmitter assembly 6 can consist of a fixed flow restrictor 8, a flow diverter 9, an adjustable flow restrictor 12, a flow control device 10 with an actuator 13, and a downstream orifice 11. The actuator 13 may be of any type, such as pneumatic, hydraulic, or electric. To send a signal or pressure pulse downhole, a portion of the total flow 3 exiting pump 2 is diverted through the bypass line 7, thereby lowering the pressure and flowrate of the fluid 4 going downhole to create a negative pulse. A negative pulse is created by operating the actuator 13 to open the choke valve 10, which opens the bypass line 7 to divert fluid through the transmitter assembly 6 away from the total flow 3 exiting the pump 2. An example flow restrictor 12 is shown in more detail as flow restrictor 210 in FIG. 2A. However, flow restrictor 210 in FIG. 2A is merely one example of a flow restrictor, and any other type of flow restrictor is also contemplated herein. Another example flow restrictor 12 is shown in more detail as flow restrictor 300 in FIG. 3. This example flow restrictor 300 comprises linear actuator 301 that can drive poppet valve 303 in either direction indicated in flow area 302. In some examples, as linear actuator 301 moves poppet valve 303 in the direction towards valve seat 304A and valve seat 304B, the amount of flow can be reduced. Alternatively, as linear actuator moves poppet valve 303 in the direction towards the linear actuator 301, the amount of flow can be increased. Importantly, the adjustable flow restrictor 12 provides the ability to self-adjust the pulse amplitude and/or downlink parameters with automation. Further, the adjustable flow restrictor 12 can provide the dual purpose of a low frequency pulser and when stationary, act as amplitude amplifier. When acting as low frequency pulser, it can work simultaneously with the high frequency siren pulser, effectively providing a frequency modulator combined with an amplitude modulator.

Figure 2B:
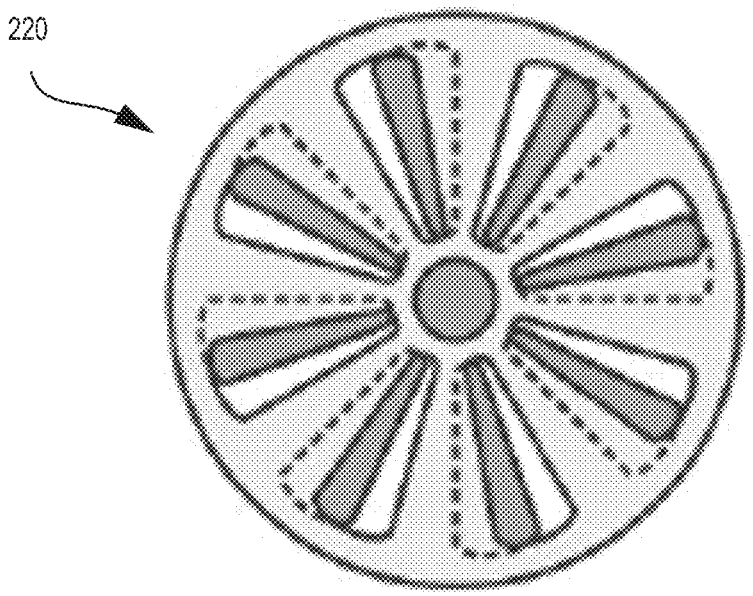
FIG. 2B illustrates another example flow restrictor, according to some examples of the present disclosure.

An example choke valve 10 is shown in more detail as choke valve 220 in FIG. 2B. However, choke valve 220 in FIG. 2B is merely one example of a flow restrictor, and any other type of flow restrictor is also contemplated herein. The amount of fluid that diverts through the bypass line 7 can be controlled either by restricting flow through the choke valve 10 or by fully opening the choke valve 10 and restricting the flow through the bypass line 7 in another way. Preferably the upstream orifice 8 can act as a flow restrictor to control the quantity of flow through the bypass line 7, thereby allowing the choke valve 10 to remain fully open. By operating the choke valve 10 in the fully open position, erosion to the choke valve 10 internals can be minimized, and the relatively low cost upstream orifice 8 can become a sacrificial wear component.

In some examples, the upstream orifice 8 is a bit jet flow restrictor. To size the bit jet restrictor 8, the surface transmitter 6 is brought on-site and hooked up with a nominal size restrictor 8 in the bypass line. Then the choke valve 10 is opened and the pressure is read at the standpipe 16 to determine how much fluid is being bypassed. To change the bypass quantity, a smaller or larger bit jet 8 is installed. The bit jet 8 is housed in a manifold assembly 27 and can be quickly changed via the access plug 5. The bit jet 8 is preferably a tungsten carbide nozzle with an orifice through the middle, and it is preferably located on the upstream side of the choke valve 10. By locating the bit jet 8 upstream of the choke valve 10, the bit jet 8 provides a reflection surface for the instantaneous positive pulses, or increases in pressure, created when the choke valve 10 is rapidly closed. These positive pulses would interfere with the uplink pulses if the bit jet 8 were not located upstream of choke valve 10. Further, the adjustable flow restrictor 12 can provide all the benefits of upstream orifice 8, while further providing the dual purpose of a low frequency pulser and when stationary, act as amplitude amplifier. When acting as low frequency pulser, adjustable flow restrictor 12 can work simultaneously with the high frequency siren pulser, effectively providing a frequency modulator combined with an amplitude modulator.

Flow diverter 9, which can be downstream of the bit jet 8 and/or adjustable flow restrictor 12, is preferably bullet-shaped, or otherwise shaped to streamline the flow as it moves past the flow diverter 9. The flow diverter 9 preferably includes a coating that resists wear, such as tungsten carbide, ceramic, or diamond composite. The flow diverter 9 can alternatively be constructed of a material that resists wear, such as solid tungsten carbide, solid ceramic, or solid Stellite. Flow diverter 9 can force the turbulent, high velocity flow that exits the bit jet 8 into a normal flow regime before entering the choke valve 10. Without the diverter 9, the drilling fluid could erode the internals of the choke valve 10 due to the high velocity exiting the bit jet 8.

Downstream of the choke valve 10 is a much larger and permanent orifice 11, preferably another bit jet, sized to match the control factor of the choke valve 10 so as to provide adequate back pressure to prevent cavitation in the choke valve 10 as the drilling fluid flows therethrough. The surface transmitter assembly 6 can be operated by a surface transmitter control system 90 comprising a computer 26, a downlink controller/barrier box 24. In some examples, the surface transmitter assembly 6 can further include an intrinsically safe pneumatic control box housing two intrinsically safe solenoid valves (not shown). In some examples, the solenoid valves can preferably be ASCO Model Number WPIS8316354 valves with ⅜" NPT connections and 150 psi maximum differential pressure.

The computer 26 can control the actual timing for generating the series of pulses by opening and closing the choke valve 10. The operator can input an instruction to the computer 26 using a graphical user interface screen. The computer 26 can encode the downlink instruction into the timing sequence used to control the choke valve 10. That encoded instruction can be transmitted to the downlink controller/barrier box 24 via a RS232 cable 25. The downlink controller/barrier box 24 can house a downlink controller, preferably a micro-controller board, along with a power supply and at least two intrinsically safe solenoid drivers. Inside the pneumatic system 59, a DC power signal can activate two intrinsically safe solenoid valves that control an air supply that operates the pneumatic actuator 13 to open and close the choke valve 10.

In operation, pressure pulses can be sent from the earth's surface by the transmitter assembly 6 down the drill string 19 to be received by the downhole receiver 21. For example, assume that the pump 2 moves drilling fluid out of the fluid reservoir 1 into the pump discharge line 37 along path 3 at a rate of 400 gallons per minute (GPM). Next assume that the choke valve 10 is momentarily opened to allow 50 GPM to run through the bypass line 7, into the pump return line 22, and back to the fluid reservoir 1. Meanwhile, drilling fluid flowing at 350 GPM travels along path 4 in the direction of the flow arrows through the standpipe 16, down the drill string 19, into the annulus 18, and back to the fluid reservoir 1 through the pump return line 22. In total, after accounting for the time lag associated with the fluid moving through the system, 400 GPM leaves the pump 2 along path 3, and 400 GPM returns to the fluid reservoir 1, with 50 GPM going through the bypass line 7 and 350 GPM going downhole. The downhole receiver 21 will detect a drop in fluid pressure and/or flow rate for the duration that the choke valve 10 is open. Hydraulic pressure drop across a flow restrictor is related to the flow rate by the following equation 1:

$$\Delta P = Q^2 \times R \qquad \text{Equation 1}$$

Where

P is pressure,

Q is flowrate, and

R is resistance to flow.

The magnitude of the drop in fluid pressure, at the downhole receiver 21, is related to the change in flow through the drill string 19 by the following equation 2:

$$|\Delta P_{PULSE}| = (Q_C^2 - Q_O^2) \times R \qquad \text{Equation 2}$$

Where $Q_C$ is the flow rate through the drill string 19 when the choke valve 10 is closed;

$Q_O$ is the flow rate through the drill string 19 when the choke valve 10 is open; and R is the resistance to flow downstream of the downhole receiver 21.

Even a small change in flow rate will cause a measurable change in downhole pressure at the downhole receiver 21. Each time the choke valve 10 is opened and then closed, a negative pulse, or decrease in downhole pressure, is detected by the downhole receiver 21.

To send an entire instruction, the choke valve 10 can be opened and closed in a predetermined set pattern to create momentary changes in pressure downhole that the downhole receiver 21 recognizes as a series of negative pulses. One advantage of the present invention is that drilling does not have to be shut down each time an instruction is sent downhole. The 50 GPM drop in the drilling flowrate due to fluid being diverted through the bypass 7 does not substantially impact the drilling operation. Although the downlink telemetry system has the advantage of not shutting down drilling operations while sending signals, the drilling operation is affected when fluid is bypassed for downlinking signals. When the drilling tool is deep within the formation, larger amplitude pulses are required to transmit the signals downhole, requiring a greater amount of fluid to be bypassed. In such circumstances, the downhole drilling operation may temporarily stall. Therefore, it can be advantageous to send and receive the signals as quickly as possible.

Continuous wave modulation (such as QPSK, for example) can provide the capability to transmit at a frequency band that is below or above the uplink telemetry frequency band. QPSK can take advantage of venting the fluid at the surface to create pulses of sufficient amplitude and frequency that can be created without the limitations of a non-venting flowline pulser. Surface transmitter can send the same data over the continuous wave and the DPPM (one or more of the DPPM pulses may contain the continuous wave data). When the downhole receiver 21 detects the continuous wave data, an algorithm that controls the downhole receiver 21, can acknowledge the downlink and the surface transmitter can stop sending the rest of the intervals of the DPPM data. Downhole receiver 21 can buffer all the data sampled during the continuous/DPPM downlink, decode the DPPM to identify encoding scheme, and use that to setup its filters for decoding the continuous wave encoded data. Then the algorithm can convert the data back into the instruction being sent downhole. In this way, the downhole receiver 21 interprets the signal to determine what instruction is being sent downhole. Thus, in summary, the downhole receiver 21 recognizes the encoding scheme, then use that information to setup its filters for decoding the continuous wave encoded data, to interpret the instruction that is being sent.

Once the algorithm decodes the instruction, a master controller housed in the downhole assembly 35 can determine which particular tool the instruction is directed to through the use of a lookup table. The master controller can then distribute the instruction to that tool, and the particular downhole tool is thereby controlled and changed as a result of the signals being sent. For example, a typical downhole assembly might house a 3-D rotary steerable drilling tool and a suite of formation evaluation tools designed, for example, to measure resistivity of the formation, porosity of the formation, or sense gamma radiation. The master controller can, for example, send instructions to the 3-D drilling tool telling the drill bit how much to deflect and in which direction to point the toolface. Or, for example, if the instruction is being sent to a formation evaluation tool, the command might instruct the tool to change modes of measurement or to turn on or off depending on what formation is being entered.

Due to the relative high speed downlink signaling and data processing that can be achieved, real time instructions can be sent and selectively verified via uplink signals to allow for quick adjustments to the downhole tool. Real advantages are achievable by combining 3-D rotary steerable drilling tools with the high-speed downlink telemetry system of the present invention. A 3-D steerable tool is capable of making incremental changes in direction in response to downlink instructions, whereas some previous downhole drilling tools made only macro changes because they included only an on or off mode, and an inclination that was either full or none. Other previous downhole drilling tools capable of making incremental changes operated at a lower resolution due to the date rate constraints. Further, some traditional downlink signaling required temporary cessation of drilling to cycle the pumps on/off to send instructions to the drilling tool, while other traditional downlink signaling without interrupting drilling relied on wideband DPPM, which can have a negative impact and/or interfere uplink telemetry. Therefore, such instructions could only be sent periodically if any forward progress was to be made in drilling. The result of using such prior art drilling tools in combination with slow downlink signaling was horizontal boreholes with snake-like profiles rather than accurately located ones as operators attempted to adjust the drilling tool at various points along its path to account for the tool being off track. The net effect was a borehole that remained on course with respect to the starting and ending points, but with a snake-like or tortuous path in between. When a tortuous borehole is drilled, the pipe being pushed or pulled into the hole tends to get stuck since it takes significantly more force to slide a long section of pipe through a tortuous hole than through an accurately located borehole that is optimized for minimum drag.

In contrast, by using a 3-D steerable drilling tool in combination with the present downlink telemetry system, the drilling tool can continuously make incremental changes to the deflection angle and to the toolface in response to the rapidly downlinked signals transmitted while drilling continues. Therefore, as the 3-D tool is drilling the borehole, the tool can frequently be send signals and adjust the direction appropriately to stay on course. Theoretically, then, an accurately located borehole can be achieved, or one that is significantly more accurately located and optimized for minimum drag than the boreholes drilled with an on/off tool in combination with a slow downlink command structure, or drilled by incrementally adjustable tools limited by a slow downlink command structure.

Another feature of the downlink telemetry system is the use of bi-directional communication. Bi-directional communication allows downlink and uplink signals to be sent at the same time without interference between the two signals. Such interference is avoided by sending downlink and uplink pulses within different frequency bands. For example, the uplink pulses may have a high frequency, while the downlink pulses may have a low frequency. Good detection results have been achieved when the uplink pulse frequency is in the range of five to ten times higher than the downlink pulse frequency, and the greater the separation in frequency, the less the likelihood of interference. To create the downlink signals, a bit jet 8 of a certain size is provided to create the desired downlink signal amplitude, and the choke valve 10 is opened and closed at a rate such that the desired frequency of pressure pulses is created. Thus, the downlink pulse frequency is adjustable and is set depending upon the drilling conditions and the frequency of the uplink signal. The downhole receiver 21 recognizes the pulses as a downlink signal due to the frequency of the signal.

Although bi-directional communication is achievable using mud pulse telemetry for both uplink and downlink signaling, other types of telemetry schemes may be used, or a combination of telemetry schemes may be used. For example, assuming downlink signals are generated using mud pulse telemetry, uplink signals may be generated using another type of telemetry, such as electromagnetic telemetry, for example, or vice versa. If the telemetry media is the same for uplink and downlink signaling, then the frequency band of the uplink and downlink signals must be sufficiently different to achieve bi-directional communication. In other examples, if the telemetry media is the same for uplink and downlink signaling, a half-duplex approach can be employed, which is not efficient nor desirable.

The detection algorithm of the present invention that is located downhole is capable of processing higher frequency downlink signals as compared to those of the prior art. Typical prior art algorithms can require longer, lower frequency downlink pulses to process a downlink instruction (such, as for example, interpreting 1 bit of information approximately every 5 seconds) than the present invention. The algorithm of the present invention is capable of providing rates of downlink signaling that are significantly faster than these known prior art systems, allowing for many more instructions to be sent downhole in the same period of time that it takes prior art systems to send a single instruction. That is, by employing a continuous wave modulation scheme, which is more narrow-band than previous approaches, higher downlinking rates can be achieved with less interference to the uplink signal. Further, higher downlinking rates can also be achieved when the downlink frequency band is shifted to be on a frequency band higher than the uplink frequency band. Thus, the detection algorithm of the present system allows for relatively higher frequency downlink signaling.

The downlink telemetry system is adjustable such that the downlink signal may be sent at any frequency with respect to the uplink signal. Theoretically, the downlink telemetry system of the present invention can be used with any uplink system to achieve bi-directional communication. If the telemetry media is the same for uplink and downlink signaling, then the frequency band of the uplink and downlink signals must be sufficiently different to achieve bi-directional communication. The difference in frequency bands between the uplink and downlink signals enables the uplink receiver 39 to filter out the downlink signal and enables the downlink receiver 21 to filter out the uplink signal. Bi-directional communication provides the advantage of continuous communication between the surface and the downhole tools such that adjustments can be made quickly while continuing to drill.

The telemetry scheme and algorithm are used by the downhole receiver 21 to decode the downlink signals into instructions to be distributed to components of the downhole assembly 35. The algorithm is a computer program, and may be encoded using any well-known programming language such as, for example, C programming language. The algorithm is downloaded into a microprocessor within the downhole assembly 35.

Quadrature phase-shift-keying (QPSK) format, which is a published, standard communication protocol known in the art, can be used for coding the downlink signals. Although any continuous wave modulation data coding format or modulation scheme is suitable, QPSK can be preferred because it can allow for continuous wave modulation instead of only pulse modulation. QPSK can take advantage of venting the fluid at the surface to create pulses of sufficient amplitude and frequency that can be created without the limitations of a non-venting flowline pulser. Continuous wave modulation (such as QPSK, for example) can provide the capability to transmit at a frequency band that is below or above the uplink telemetry frequency band. Further, the system can support more than one downlink telemetry modulation scheme (such as QPSK and DPPM, for example) at the same time or can switch between one or more modulation schemes. Adjustable flow restrictor 12 can provide the ability to self-adjust the pulse amplitude and/or downlink parameters with automation. Downhole firmware can monitor how two modulation schemes are working, if it is able to detect the faster continuous wave modulation and what the SNR looks like. If SNR/detection for the continuous wave downlink looks incorrect or if none have been seen any for a given timeout period downhole algorithm may automatically switch to detecting at the next lower encoding (ex. 8-PSK→QPSK→BPSK etc.) and may indicate this as part of the diagnostics data pulsed up.

Continuous wave data may be encoded in such a way that it can form one or more of the DPPM pulses. During the initial stages (at different depths as SNR changes and a baseline needs to be established), surface can send the same data over the continuous as well as DPPM (one or more of the DPPM pulses may contain the continuous wave data). For example, if downhole receiver 21 detects the continuous wave data, then it may acknowledge the downlink and surface may stop sending the rest of the intervals of the DPPM data. The combination of DPPM and continuous wave can be used in multiple ways. For example, DPPM can act as a slower (but more reliable) backup in case the continuous wave is not working (this can be used to establish baseline as described above as well as for important downlinks like the one that control well trajectory). Further, the combination of DPPM and continuous wave can provide a mechanism to send multiple, but related, downlink items at the same time (e.g., continuous wave can contain data to change inclination and DPPM can contain data to change Azimuth, which can be slower). Additionally, the combination of DPPM and continuous wave can act as a mechanism to send coarse- and fine-grained control data (e.g., continuous wave can control a super fine correction to toolface while DPPM can contain the coarser data as backup in case continuous wave fails). Furthermore, DPPM can be used as an OOB ("out of band") mechanism to indicate to the downhole tool what encoding scheme the continuous wave data should be decoded with. This way downhole firmware can buffer all the data sampled during the continuous/DPPM downlink, decode the DPPM to identify encoding scheme, and use that to setup its filters for decoding the continuous wave encoded data.

Figure 4:
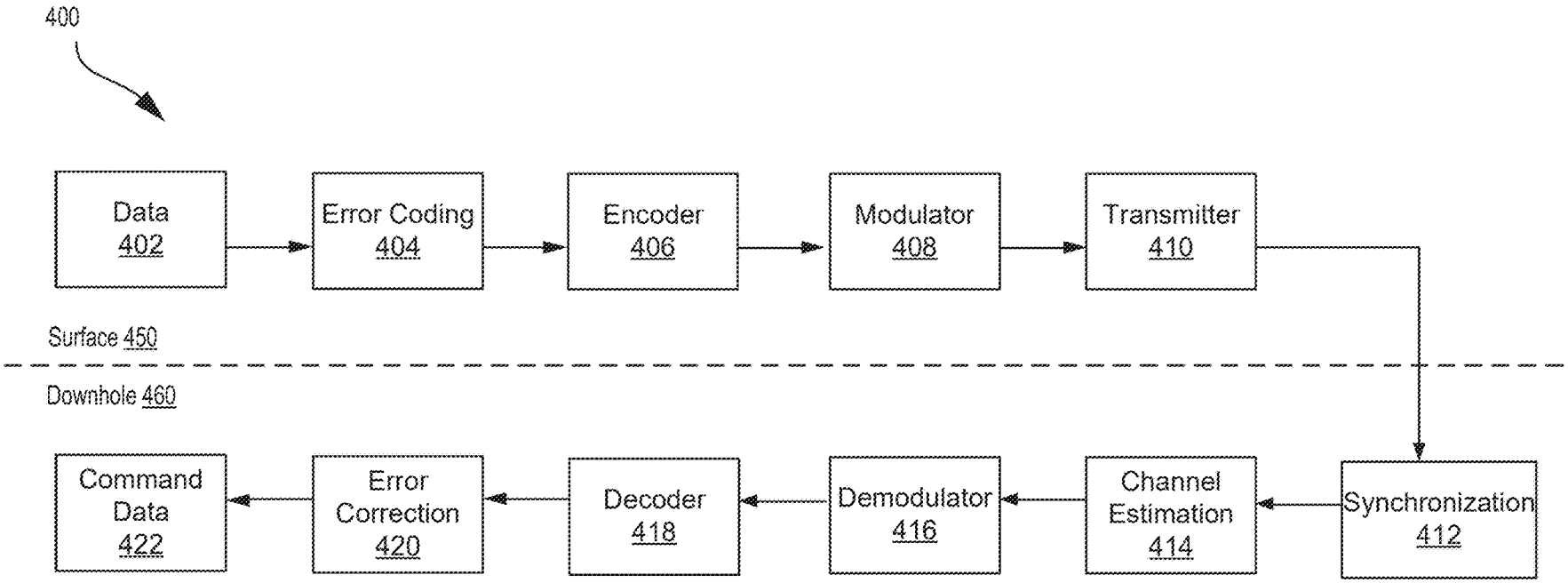
FIG. 4 illustrates an example process for encoding data at the surface, transmitting the data downhole, and decoding the data, according to some examples of the present disclosure.

FIG. 4 illustrates an example process 400 for encoding data at the surface, transmitting the data downhole and decoding the data (at downhole receiver 21, for example). At module 402, data can be created to transmit downhole. In some examples, data 402 can include instructions in the form of commands to the drilling assembly. For example, in a directional drilling operation, data can include commands to instruct the drilling apparatus to alter the direction of the drill bit by a particular angle or to change the direction of the toolface. At module 404, the process 400 can include error coding the data 402 to assure that the downhole receiver 21 receives the correct data (or command, etc.). Any known method of verifying the instruction before executing it can be applicable. However, if the downhole receiver (e.g., downhole receiver 21) determines that a downlink signal was improperly received, an uplink signal can be sent to indicate an error, and the downlink signal can be retransmitted. Further, in some examples, module 404 can also include error-correcting bits that can allow downhole receiver 21 to correct any errors in the bits without requiring the data to be re-sent.

At module 406, the process 400 can include encoding the data 402 with a format and packaging the data prior to modulation. For example, the data 402 may be encoded using any well-known programming language such as, for example, C programming language. At module 408, the process 400 can include modulating the data 402 for transmission downhole. In some examples, modulation can include continuous wave modulation in such a way that it can form one or more DPPM pulses. During the initial stages (at different depths as SNR changes and a baseline needs to be established), surface may send the same data over the continuous as well as DPPM (one or more of the DPPM pulses may contain the continuous wave data). If downhole detects the continuous wave data, then it may acknowledge the downlink and surface may stop sending the rest of the intervals of the DPPM data. At module 410, the process 400 can include transmitting the data 402 downhole by way of a physical transmitter, for example. As discussed in detail above, the system can comprise a surface transmitter for generating pressure pulses, a control system for operating the transmitter, and a downhole receiver for receiving and decoding the downlink signals into instructions to the downhole tools.

At module 412, the process 400 can include synchronizing the data 402. For example, synchronization can ensure that the surface and downhole are aligned in time, allowing for reliable and accurate transfer of data. In some examples, this can be achieved through the use of timing signals (typically generated by a clock) to ensure both devices are operating at the same pace. At module 414, the process 400 can include performing a channel estimation 414 that can estimate one or more characteristics of the signal transmitted between the transmitter and receiver. In some examples, channel estimation module 414 can enable the downhole receiver to compensate for channel distortions (for example, fading, multipath propagation, and/or interference) and can improve signal detection and overall system performance to enhance the reliability of the transmitted signal.

At module 416, the process 400 can include demodulator 416 to demodulate the transmitted data. For example, at module 416, the process 400 can remove the modulation from the received signal to recover the original data 402. At module 418, the process 400 can include a decoder (e.g., decoder 418). For example, a downhole receiver (e.g., downhole receiver 21) can decode the received signals to distribute the instruction to the proper downhole tool. The receiver can detect noise associated with the pump and drilling operations in addition to the downlink signal. In other examples, detecting noise associated with the pump and drilling operations in addition to the downlink signal can be done by either demodulator 416 or during channel estimation module 414. In some examples, decoding the downlink signal in the downhole receiver can comprises digital filtering steps to remove the noise and using a detection algorithm to match the pressure pulse sequence to a particular pre-programmed instruction in the downhole assembly controller. In some cases, the telemetry scheme and algorithm for decoding the downlink signals can be programmed into the downhole receiver 21.

Figure 5:
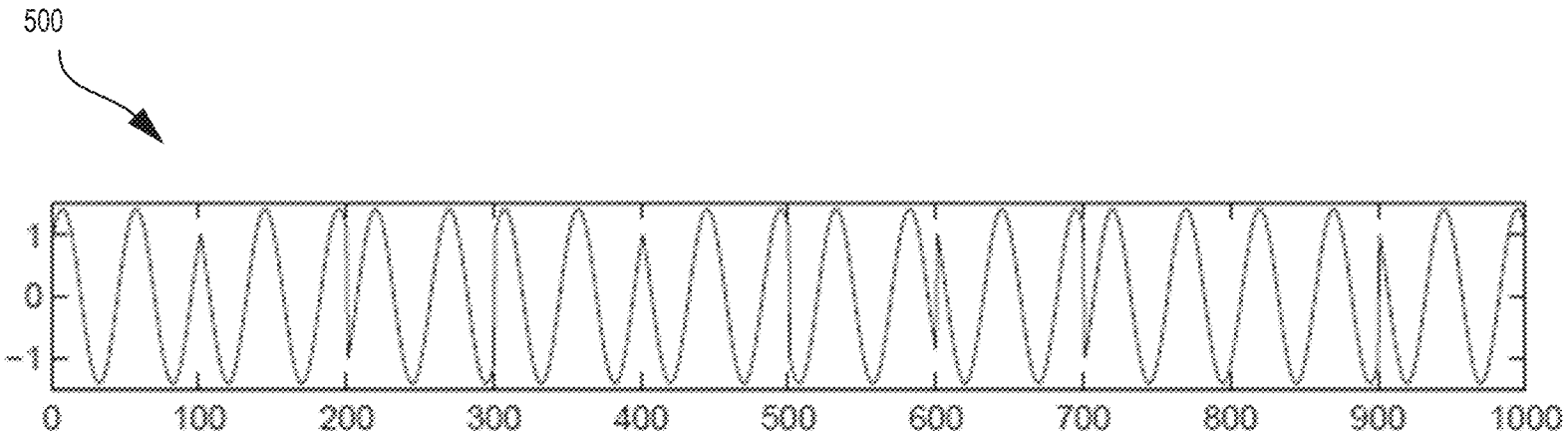
FIG. 5 illustrates an example quadrature phase-shift-keying ("QPSK") signal modulation signal that can be used to transmit data, according to some examples of the present disclosure.

At module 420, the process 400 can include error correction 420 to verify that the received data is correct. For example, any standard error-checking method known in the art that is suitable for performing a parity calculation (e.g., Cyclic Redundancy Coding (CRC)) can be used. At module 422, the process 400 can include command data 422. For example, when an instruction is pulsed to the downhole assembly 35, an algorithm can determine the instruction "command" and "data." The "command" VALUE can be used by a master controller in a lookup table to decode which tool is being instructed and what the tool is being commanded to do. The master controller can then use the "data" VALUE in the lookup table to determine the magnitude of change the tool is being instructed to make for the given command. The master controller can then distribute the decoded instruction to the appropriate tool to make its correction. FIG. 5 shows an example QPSK signal modulation signal that can be used to transmit data at higher frequencies than previous methods.

Figure 6:
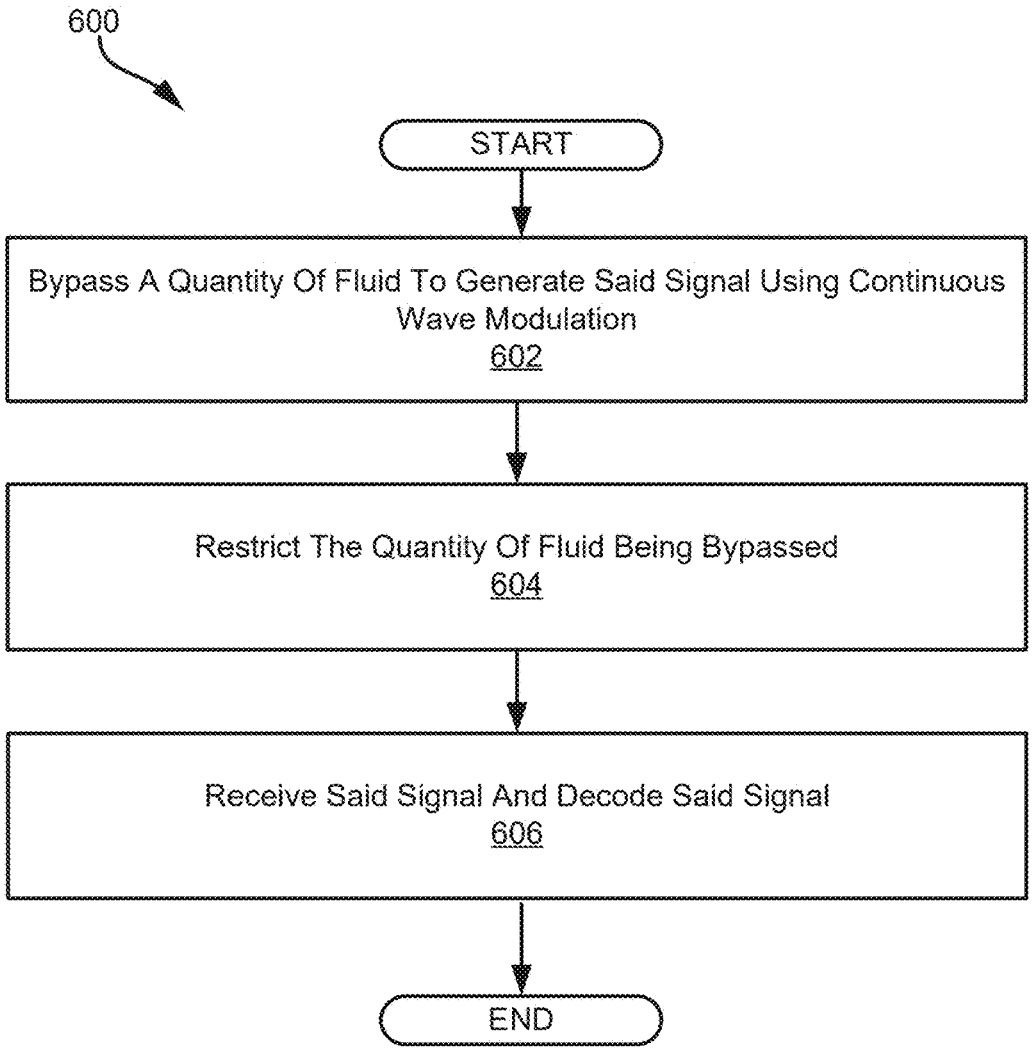
FIG. 6 illustrates a flow diagram of an example process for generating a signal in a flow of fluid being directed downhole for communicating with a downhole assembly, according to some examples of the present disclosure.

FIG. 6 illustrates a flow diagram of an example process 600 for generating a signal in a flow of fluid being directed downhole for communicating with a downhole assembly. Process 600 can be performed by processing logic that can comprise hardware (e.g., circuitry, dedicated logic, programmable logic, microcode, etc.), software (e.g., instructions executing on a processing device), or a combination thereof.

It is to be appreciated that not all steps may be needed to perform the disclosure provided herein. Further, some of the steps may be performed simultaneously, or in a different order than shown in FIG. 6, as will be understood by a person of ordinary skill in the art. Process 600 shall be described with reference to FIG. 1. However, process 600 is not limited to that example.

At block 602, the process 600 can include bypassing a quantity of fluid to generate a signal using continuous wave modulation. For example, the signals can be created on the surface by bypassing (or venting) a small percentage of the fluid away from the borehole. Further, using continuous wave modulation can provide more narrow-band while still allowing a higher downlinking data rate. As discussed above, it can also provide flexibility on which frequency band to transmit the downlink signals without impacting uplink telemetry. Further, it can also take advantage of venting the fluid at the surface to create pulses of sufficient amplitude and frequency that can be created without the limitations of a non-venting flowline pulser. Continuous wave modulation can provide the capability to transmit data at a frequency band that is either below or above the uplink telemetry frequency band.

Specifically, pressure pulses can be created and encoded using a continuous wave modulation scheme for downlink communications by momentarily bypassing a small percentage of the total flow. Continuous wave modulation can result in narrow-band and still allow for a faster downlinking data rate. The ability to communicate faster with the downhole tools can allow for smarter downhole tools that can take advantage of machine learning and also be designed for full automation. Specifically, by using this bypassing (i.e., "venting") method, larger pulses can be created that can allow for downhole tools to receive downlinks at deep wells.

Additionally, the system and method can provide the capability to support more than one downlink telemetry modulation scheme (such as, but not limited to, QPSK and/or DPPM) at the same time. The systems and methods can switch between different modulation schemes. Additional advantages can also include the ability to self-adjust the pulse amplitude and/or downlink parameters using automation. An adjustable bean choke can further act as a low frequency pulser and when stationary, act as amplitude amplifier. When acting as low frequency pulser, it can work simultaneously with the high frequency siren pulser, effectively providing a frequency modulator combined with an amplitude modulator.

At block 604, the process 600 can include restricting the quantity of fluid being bypassed. Specifically, during the momentary bypass period, pressure and volumetric flow rate are reduced in the flow traveling downhole to create a negative pulse that is transmitted down the drill string 19. This negative pulse is detected downhole by the downhole receiver 21 as a momentary change in the fluid pressure and/or a change in the fluid velocity. In some examples, as discussed above, the bit jet 8 of a certain size is provided to create the desired downlink signal amplitude, and the choke valve 10 is opened and closed at a rate such that the desired frequency of pressure pulses is created. Thus, the downlink pulse frequency is adjustable and is set depending upon the drilling conditions and the frequency of the uplink signal. The downhole receiver 21 can recognize the pulses as a downlink signal due to the frequency and/or modulation of the signal.

At block 606, the process 600 can include receiving the signal and decoding the signal. Continuous wave modulation (such as QPSK, for example) can provide the capability to transmit at a frequency band that is below or above the uplink telemetry frequency band. QPSK can take advantage of venting the fluid at the surface to create pulses of sufficient amplitude and frequency that can be created without the limitations of a non-venting flowline pulser. Surface transmitter can send the same data over the continuous wave and the DPPM (one or more of the DPPM pulses may contain the continuous wave data). When the downhole receiver 21 detects the continuous wave data, an algorithm that controls the downhole receiver 21 can acknowledge the downlink and the surface transmitter can stop sending the rest of the intervals of the DPPM data. Downhole receiver 21 can buffer all the data sampled during the continuous/DPPM downlink, decode the DPPM to identify encoding scheme, and use that to set up its filters for decoding the continuous wave encoded data. Then the algorithm can convert the data back into the instruction being sent downhole. In this way, the downhole receiver 21 interprets the signal to determine what instruction is being sent downhole. Thus, in summary, the downhole receiver 21 recognizes the encoding scheme, then use that information to setup its filters for decoding the continuous wave encoded data, to interpret the instruction that is being sent.

Once the algorithm decodes the instruction, a master controller housed in the downhole assembly 35 can determine which particular tool the instruction is directed to through the use of a lookup table. The master controller can then distribute the instruction to that tool, and the particular downhole tool is thereby controlled and changed as a result of the signals being sent. For example, a typical downhole assembly might house a 3-D rotary steerable drilling tool and a suite of formation evaluation tools designed, for example, to measure resistivity of the formation, porosity of the formation, or sense gamma radiation. The master controller can, for example, send instructions to the 3-D drilling tool telling the drill bit how much to deflect and in which direction to point the toolface. Or, for example, if the instruction is being sent to a formation evaluation tool, the command might instruct the tool to change modes of measurement or to turn on or off depending on what formation is being entered.

Figure 7:
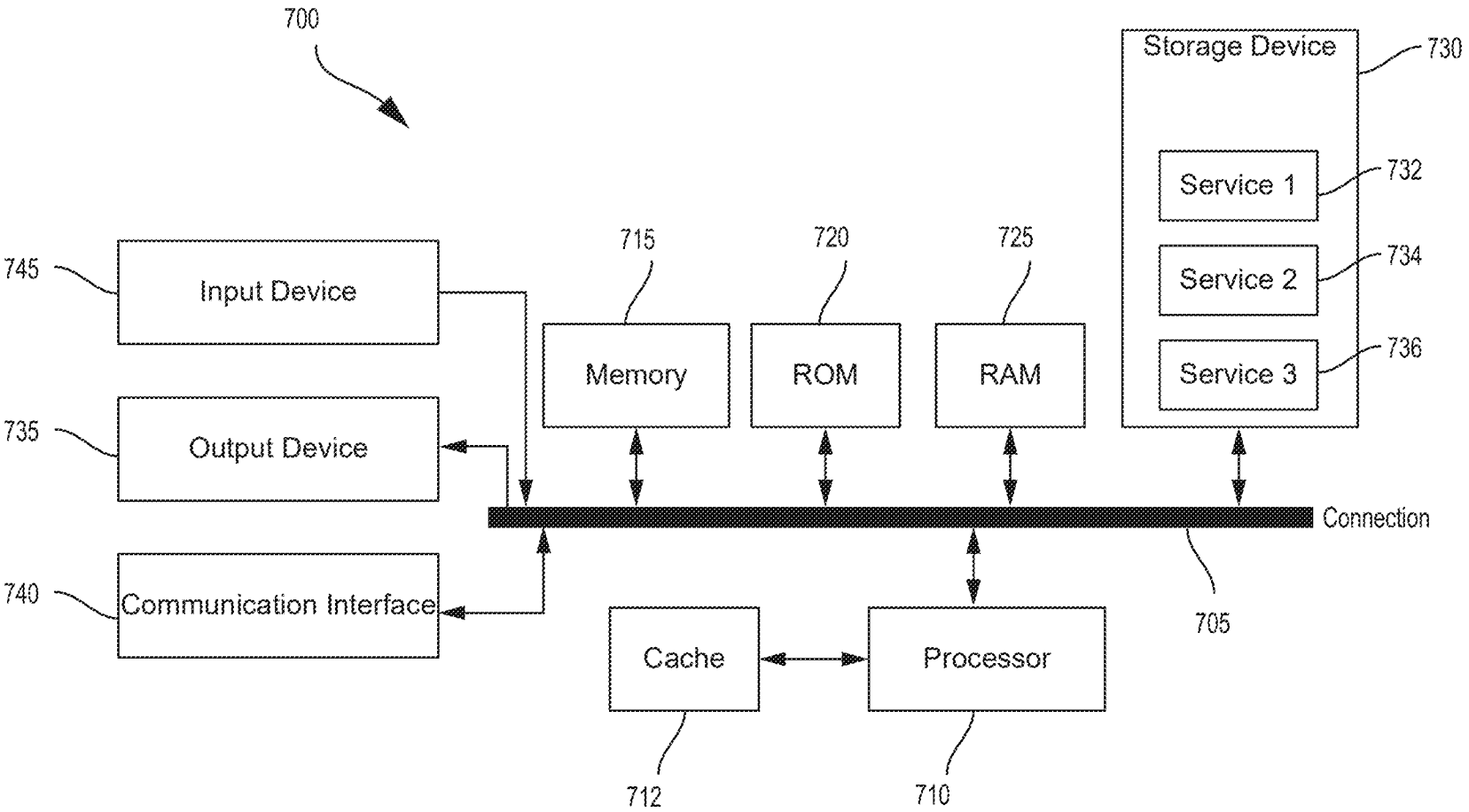
FIG. 7 illustrates an example processor-based system with which some aspects of the subject technology can be implemented, according to some examples of the present disclosure.

FIG. 7 illustrates an example processor-based system with which some aspects of the subject technology can be implemented. For example, processor-based system 700 can be any computing device, or any component thereof, in which the components of the system are in communication with each other using connection 705. Connection 705 can be a physical connection via a bus, or a direct connection into processor 710, such as in a chipset architecture. Connection 705 can also be a virtual connection, networked connection, or logical connection.

In some embodiments, computing system 700 is a distributed system in which the functions described in this disclosure can be distributed within a datacenter, multiple data centers, a peer network, etc. In some embodiments, one or more of the described system components represents many such components each performing some or all of the function for which the component is described. In some embodiments, the components can be physical or virtual devices.

Example system 700 includes at least one processing unit (Central Processing Unit (CPU) or processor) 710 and connection 705 that couples various system components including system memory 715, such as Read-Only Memory (ROM) 720 and Random-Access Memory (RAM) 725 to processor 710. Computing system 700 can include a cache of high-speed memory 712 connected directly with, in close proximity to, or integrated as part of processor 710.

Processor 710 can include any general-purpose processor and a hardware service or software service, such as services 732, 734, and 736 stored in storage device 730, configured to control processor 710 as well as a special-purpose processor where software instructions are incorporated into the actual processor design. Processor 710 may essentially be a completely self-contained computing system, containing multiple cores or processors, a bus, memory controller, cache, etc. A multi-core processor may be symmetric or asymmetric.

To enable user interaction, computing system 700 includes an input device 745, which can represent any number of input mechanisms, such as a microphone for speech, a touch-sensitive screen for gesture or graphical input, keyboard, mouse, motion input, speech, etc. Computing system 700 can also include output device 735, which can be one or more of a number of output mechanisms known to those of skill in the art. In some instances, multimodal systems can enable a user to provide multiple types of input/output to communicate with computing system 700. Computing system 700 can include communications interface 740, which can generally govern and manage the user input and system output. The communication interface may perform or facilitate receipt and/or transmission wired or wireless communications via wired and/or wireless transceivers, including those making use of an audio jack/plug, a microphone jack/plug, a Universal Serial Bus (USB) port/plug, an Apple® Lightning® port/plug, an Ethernet port/plug, a fiber optic port/plug, a proprietary wired port/plug, a BLUETOOTH® wireless signal transfer, a BLUETOOTH® low energy (BLE) wireless signal transfer, an IBEACON® wireless signal transfer, a Radio-Frequency Identification (RFID) wireless signal transfer, Near-Field Communications (NFC) wireless signal transfer, Dedicated Short Range Communication (DSRC) wireless signal transfer, 802.11 Wi-Fi® wireless signal transfer, Wireless Local Area Network (WLAN) signal transfer, Visible Light Communication (VLC) signal transfer, Worldwide Interoperability for Microwave Access (WiMAX), Infrared (IR) communication wireless signal transfer, Public Switched Telephone Network (PSTN) signal transfer, Integrated Services Digital Network (ISDN) signal transfer, 3G/4G/5G/LTE cellular data network wireless signal transfer, ad-hoc network signal transfer, radio wave signal transfer, microwave signal transfer, infrared signal transfer, visible light signal transfer signal transfer, ultraviolet light signal transfer, wireless signal transfer along the electromagnetic spectrum, or some combination thereof.

Communication interface 740 may also include one or more Global Navigation Satellite System (GNSS) receivers or transceivers that are used to determine a location of the computing system 700 based on receipt of one or more signals from one or more satellites associated with one or more GNSS systems. GNSS systems include, but are not limited to, the US-based Global Positioning System (GPS), the Russia-based Global Navigation Satellite System (GLONASS), the China-based BeiDou Navigation Satellite System (BDS), and the Europe-based Galileo GNSS. There is no restriction on operating on any particular hardware arrangement, and therefore the basic features here may easily be substituted for improved hardware or firmware arrangements as they are developed.

Storage device 730 can be a non-volatile and/or non-transitory and/or computer-readable memory device and can be a hard disk or other types of computer readable media which can store data that are accessible by a computer, such as magnetic cassettes, flash memory cards, solid state memory devices, digital versatile disks, cartridges, a floppy disk, a flexible disk, a hard disk, magnetic tape, a magnetic strip/stripe, any other magnetic storage medium, flash memory, memristor memory, any other solid-state memory, a Compact Disc (CD) Read Only Memory (CD-ROM) optical disc, a rewritable CD optical disc, a Digital Video Disk (DVD) optical disc, a Blu-ray Disc (BD) optical disc, a holographic optical disk, another optical medium, a Secure Digital (SD) card, a micro SD (microSD) card, a Memory Stick® card, a smartcard chip, a EMV chip, a Subscriber Identity Module (SIM) card, a mini/micro/nano/pico SIM card, another Integrated Circuit (IC) chip/card, Random-Access Memory (RAM), Atatic RAM (SRAM), Dynamic RAM (DRAM), Read-Only Memory (ROM), Programmable ROM (PROM), Erasable PROM (EPROM), Electrically Erasable PROM (EEPROM), flash EPROM (FLASHEPROM), cache memory (L1/L2/L3/L4/L5/L #), Resistive RAM (RRAM/ReRAM), Phase Change Memory (PCM), Spin Transfer Torque RAM (STT-RAM), another memory chip or cartridge, and/or a combination thereof.

Storage device 730 can include software services, servers, services, etc., that when the code that defines such software is executed by the processor 710, it causes the system 700 to perform a function. In some embodiments, a hardware service that performs a particular function can include the software component stored in a computer-readable medium in connection with the necessary hardware components, such as processor 710, connection 705, output device 735, etc., to carry out the function.

For clarity of explanation, in some instances the present technology may be presented as including individual functional blocks including functional blocks comprising devices, device components, steps or routines in a method embodied in software, or combinations of hardware and software.

In some embodiments the computer-readable storage devices, mediums, and memories can include a cable or wireless signal containing a bit stream and the like. However, when mentioned, non-transitory computer-readable storage media expressly exclude media such as energy, carrier signals, electromagnetic waves, and signals per se.

Methods according to the above-described examples can be implemented using computer-executable instructions that are stored or otherwise available from computer readable media. Such instructions can include, for example, instructions and data which cause or otherwise configure a general purpose computer, special purpose computer, or a processing device to perform a certain function or group of functions. Portions of computer resources used can be accessible over a network. The computer executable instructions may be, for example, binaries, intermediate format instructions such as assembly language, firmware, source code, etc. Examples of computer-readable media that may be used to store instructions, information used, and/or information created during methods according to described examples include magnetic or optical disks, flash memory, USB devices provided with non-volatile memory, networked storage devices, and so on.

Devices implementing methods according to these disclosures can include hardware, firmware and/or software, and can take any of a variety of form factors. Typical examples of such form factors include laptops, smart phones, small form factor personal computers, personal digital assistants, rackmount devices, standalone devices, and so on. Functionality described herein also can be embodied in peripherals or add-in cards. Such functionality can also be implemented on a circuit board among different chips or different processes executing in a single device, by way of further example.

The instructions, media for conveying such instructions, computing resources for executing them, and other structures for supporting such computing resources are example means for providing the functions described in the disclosure.

In the foregoing description, aspects of the application are described with reference to specific embodiments thereof, but those skilled in the art will recognize that the application is not limited thereto. Thus, while illustrative embodiments of the application have been described in detail herein, it is to be understood that the disclosed concepts may be otherwise variously embodied and employed, and that the appended claims are intended to be construed to include such variations, except as limited by the prior art. Various features and aspects of the above-described subject matter may be used individually or jointly. Further, embodiments can be utilized in any number of environments and applications beyond those described herein without departing from the broader spirit and scope of the specification. The specification and drawings are, accordingly, to be regarded as illustrative rather than restrictive. For the purposes of illustration, methods were described in a particular order. It should be appreciated that in alternate embodiments, the methods may be performed in a different order than that described.

Where components are described as being "configured to" perform certain operations, such configuration can be accomplished, for example, by designing electronic circuits or other hardware to perform the operation, by programming programmable electronic circuits (e.g., microprocessors, or other suitable electronic circuits) to perform the operation, or any combination thereof.

The various illustrative logical blocks, modules, circuits, and algorithm steps described in connection with the examples disclosed herein may be implemented as electronic hardware, computer software, firmware, or combinations thereof. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present application.

The techniques described herein may also be implemented in electronic hardware, computer software, firmware, or any combination thereof. Such techniques may be implemented in any of a variety of devices such as general purposes computers, wireless communication device handsets, or integrated circuit devices having multiple uses including application in wireless communication device handsets and other devices. Any features described as modules or components may be implemented together in an integrated logic device or separately as discrete but interoperable logic devices. If implemented in software, the techniques may be realized at least in part by a computer-readable data storage medium comprising program code including instructions that, when executed, performs one or more of the method, algorithms, and/or operations described above. The computer-readable data storage medium may form part of a computer program product, which may include packaging materials.

The computer-readable medium may include memory or data storage media, such as random access memory (RAM) such as synchronous dynamic random access memory (SDRAM), read-only memory (ROM), non-volatile random access memory (NVRAM), electrically erasable programmable read-only memory (EEPROM), FLASH memory, magnetic or optical data storage media, and the like. The techniques additionally, or alternatively, may be realized at least in part by a computer-readable communication medium that carries or communicates program code in the form of instructions or data structures and that can be accessed, read, and/or executed by a computer, such as propagated signals or waves.

Other embodiments of the disclosure may be practiced in network computing environments with many types of computer system configurations, including personal computers, hand-held devices, multi-processor systems, microprocessor-based or programmable consumer electronics, network PCs, minicomputers, mainframe computers, and the like. Embodiments may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

In the above description, terms such as "upper," "upward," "lower," "downward," "above," "below," "downhole," "uphole," "longitudinal," "lateral," and the like, as used herein, shall mean in relation to the bottom or furthest extent of the surrounding wellbore even though the wellbore or portions of it may be deviated or horizontal. Correspondingly, the transverse, axial, lateral, longitudinal, radial, etc., orientations shall mean orientations relative to the orientation of the wellbore or tool. Additionally, the illustrate embodiments are illustrated such that the orientation is such that the right-hand side is downhole compared to the left-hand side.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or another word that substantially modifies, such that the component need not be exact. For example, substantially cylindrical means that the object resembles a cylinder, but can have one or more deviations from a true cylinder.

The term "axially" means substantially along a direction of the axis of the object. If not specified, the term axially is such that it refers to the longer axis of the object.

Although a variety of information was used to explain aspects within the scope of the appended claims, no limitation of the claims should be implied based on particular features or arrangements, as one of ordinary skill would be able to derive a wide variety of implementations. Further and although some subject matter may have been described in language specific to structural features and/or method steps, it is to be understood that the subject matter defined in the appended claims is not necessarily limited to these described features or acts. Such functionality can be distributed differently or performed in components other than those identified herein. The described features and steps are disclosed as possible components of systems and methods within the scope of the appended claims.

Claim language or other language in the disclosure reciting "at least one of" a set and/or "one or more" of a set indicates that one member of the set or multiple members of the set (in any combination) satisfy the claim. For example, claim language reciting "at least one of A and B" or "at least one of A or B" means A, B, or A and B. In another example, claim language reciting "at least one of A, B, and C" or "at least one of A, B, or C" means A, B, C, or A and B, or A and C, or B and C, or A and B and C. The language "at least one of" a set and/or "one or more" of a set does not limit the set to the items listed in the set. For example, claim language reciting "at least one of A and B" or "at least one of A or B" can mean A, B, or A and B, and can additionally include items not listed in the set of A and B.

SELECTED EXAMPLES

Illustrative examples of the disclosure include:

Aspect 1. A method for generating a signal in a flow of fluid being directed downhole for communicating with a downhole assembly comprising: bypassing a quantity of fluid to generate said signal using continuous wave modulation; restricting the quantity of fluid being bypassed; and receiving said signal and decoding said signal.

Aspect 2. The method of Aspect 1, wherein bypassing the quantity of fluid to generate said signal using continuous wave modulation includes bypassing the quantity of fluid without stopping an entirety of the flow of fluid directed downhole.

Aspect 3. The method of either Aspect 1 or 2, wherein restricting the quantity of fluid being bypassed includes automatically self-adjusting the quantity to adjust at least one of a pulse amplitude and a downlink parameter.

Aspect 4. The method of any of Aspects 1 through 3, wherein the signal comprises one or more pressure pulses.

Aspect 5. The method of any of Aspects 1 through 4, wherein said continuous wave modulation comprises using more than one downlink telemetry modulation scheme at the same time.

Aspect 6. The method of any of any of Aspects 1 through 5, further comprising switching between the more than one downlink telemetry modulation schemes.

Aspect 7. The method of any of Aspects 1 through 6, wherein switching between the more than one downlink telemetry modulation schemes includes monitoring the more than one downlink telemetry modulation schemes to determine one or more errors associated with the more than one downlink telemetry modulation schemes; and automatically switching to detecting at a next lower encoding scheme.

Aspect 8. The method of any of Aspects 1 through 7, wherein said continuous wave modulation includes data encoded to form one or more Differential Pulse Position Modulation pulses.

Aspect 9. The method of any of Aspects 1 through 8, wherein said continuous wave modulation including data encoded to form one or more Differential Pulse Position Modulation pulses transmits multiple related downlink items simultaneously.

Aspect 10. The method of any of Aspects 1 through 9, wherein said one or more Differential Pulse Position Modulation pulses provides an out of band mechanism to indicate to a downhole tool an encoding scheme to employ to decode said continuous wave modulation.

Aspect 11. A system for generating a signal in a flow of fluid being directed downhole for communicating with a downhole assembly comprising: a flow control device for bypassing a quantity of fluid to generate said signal using continuous wave modulation; a flow restrictor for restricting the quantity of fluid being bypassed; and a downhole receiver for receiving said signal and decoding said signal.

Aspect 12. The system of Aspect 11, wherein bypassing the quantity of fluid to generate said signal using continuous wave modulation includes bypassing the quantity of fluid without stopping an entirety of the flow of fluid directed downhole.

Aspect 13. The system of either Aspect 11 or 12, wherein restricting the quantity of fluid being bypassed includes automatically self-adjusting the quantity to adjust at least one of a pulse amplitude and a downlink parameter.

Aspect 14. The system of any of Aspects 11 through 13, wherein the signal comprises one or more pressure pulses.

Aspect 15. The system of any of Aspects 11 through 14, wherein said continuous wave modulation comprises using more than one downlink telemetry modulation scheme at the same time.

Aspect 16. The system of any of Aspects 11 through 15, further comprising switching between the more than one downlink telemetry modulation schemes.

Aspect 17. The system of any of Aspects 11 through 16, wherein switching between the more than one downlink telemetry modulation schemes includes monitoring the more than one downlink telemetry modulation schemes to determine one or more errors associated with the more than one downlink telemetry modulation schemes; and automatically switching to detecting at a next lower encoding scheme.

Aspect 18. The system of any of Aspects 11 through 17, wherein said continuous wave modulation includes data encoded to form one or more Differential Pulse Position Modulation pulses.

Aspect 19. The system of any of Aspects 11 through 18, wherein said continuous wave modulation including data encoded to form one or more Differential Pulse Position Modulation pulses transmits multiple related downlink items simultaneously.

Aspect 20. The system of any of Aspects 11 through 19, wherein said one or more Differential Pulse Position Modulation pulses provides an out of band mechanism to indicate to a downhole tool an encoding scheme to employ to decode said continuous wave modulation.

Aspect 21. A system comprising means for performing a method according to any of Aspects 1 through 20.

What is claimed is:

1. A method for generating a signal in a flow of fluid being directed downhole for communicating with a downhole assembly comprising:

bypassing a quantity of fluid to generate said signal using continuous wave modulation, wherein said continuous wave modulation includes data encoded to form one or more Differential Pulse Position Modulation pulses and wherein said one or more Differential Pulse Position Modulation pulses provides an out of band mechanism to indicate to a downhole tool an encoding scheme to employ to decode said continuous wave modulation;

restricting the quantity of fluid being bypassed; and receiving said signal and decoding said signal.

2. The method of claim 1, wherein bypassing the quantity of fluid to generate said signal using continuous wave modulation includes bypassing the quantity of fluid without stopping an entirety of the flow of fluid directed downhole.

3. The method of claim 1, wherein restricting the quantity of fluid being bypassed includes automatically self-adjusting the quantity to adjust at least one of a pulse amplitude and a downlink parameter.

4. The method of claim 1, wherein the signal comprises one or more pressure pulses.

5. The method of claim 1, wherein said continuous wave modulation comprises using more than one downlink telemetry modulation scheme at the same time.

6. The method of claim 5, further comprising switching between the more than one downlink telemetry modulation schemes.

7. The method of claim 6 wherein switching between the more than one downlink telemetry modulation schemes includes monitoring the more than one downlink telemetry modulation schemes to determine one or more errors associated with the more than one downlink telemetry modulation schemes; and automatically switching to detecting at a next lower encoding scheme.

8. The method of claim 1, wherein said continuous wave modulation including data encoded to form one or more Differential Pulse Position Modulation pulses transmits multiple related downlink items simultaneously.

9. A system for generating a signal in a flow of fluid being directed downhole for communicating with a downhole assembly comprising:

a flow control device for bypassing a quantity of fluid to generate said signal using continuous wave modulation, wherein said continuous wave modulation includes data encoded to form one or more Differential Pulse Position Modulation pulses and wherein said one or more Differential Pulse Position Modulation pulses provides an out of band mechanism to indicate to a downhole tool an encoding scheme to employ to decode said continuous wave modulation;

a flow restrictor for restricting the quantity of fluid being bypassed; and a downhole receiver for receiving said signal and decoding said signal.

10. The system of claim 9, wherein bypassing the quantity of fluid to generate said signal using continuous wave modulation includes bypassing the quantity of fluid without stopping an entirety of the flow of fluid directed downhole.

11. The system of claim 9, wherein restricting the quantity of fluid being bypassed includes automatically self-adjusting the quantity to adjust at least one of a pulse amplitude and a downlink parameter.

12. The system of claim 9, wherein the signal comprises one or more pressure pulses.

13. The system of claim 9, wherein said continuous wave modulation comprises using more than one downlink telemetry modulation scheme at the same time.

14. The system of claim 13, further comprising switching between the more than one downlink telemetry modulation schemes.

15. The system of claim 14, wherein switching between the more than one downlink telemetry modulation schemes includes monitoring the more than one downlink telemetry modulation schemes to determine one or more errors associated with the more than one downlink telemetry modulation schemes; and automatically switching to detecting at a next lower encoding scheme.

16. The system of claim 9, wherein said continuous wave modulation including data encoded to form one or more Differential Pulse Position Modulation pulses transmits multiple related downlink items simultaneously.

* * * * *